US008040256B2

(12) United States Patent
Rani et al.

(10) Patent No.: US 8,040,256 B2
(45) Date of Patent: Oct. 18, 2011

(54) CONTEXT SENSITIVE SPEED TRACKING

(75) Inventors: Ananth Rani, Fremont, CA (US); Sivakumar Venkatraman, San Jose, CA (US)

(73) Assignee: Xora, Inc., Mountain View, CA (US)

( * ) Notice: Subject to any disclaimer, the term of this patent is extended or adjusted under 35 U.S.C. 154(b) by 323 days.

(21) Appl. No.: 12/291,009

(22) Filed: Nov. 5, 2008

(65) Prior Publication Data

US 2009/0140883 A1 Jun. 4, 2009

Related U.S. Application Data

(60) Provisional application No. 61/001,820, filed on Nov. 5, 2007.

(51) Int. Cl.
*G08G 1/01* (2006.01)

(52) U.S. Cl. ..... 340/936; 340/539.1; 340/441

(58) Field of Classification Search ..... 340/936, 340/905, 441, 539.13, 995.13, 988, 989; 455/456.1, 456.3; 701/117, 119, 200
See application file for complete search history.

(56) References Cited

U.S. PATENT DOCUMENTS

| | | | | |
|---|---|---|---|---|
| 5,652,707 | A * | 7/1997 | Wortham | 455/456.3 |
| 6,462,675 | B1 * | 10/2002 | Humphrey et al. | 340/905 |
| 7,657,367 | B1 * | 2/2010 | Phuyal et al. | 701/117 |
| 7,680,594 | B2 * | 3/2010 | Cabral et al. | 701/209 |
| 7,701,363 | B1 * | 4/2010 | Zlojutro | 340/988 |
| 7,783,406 | B2 * | 8/2010 | Rothschild | 701/93 |

* cited by examiner

*Primary Examiner* — Daniel Previl
(74) *Attorney, Agent, or Firm* — Moser Taboada

(57) ABSTRACT

A method and apparatus for performing a context sensitive speed tracking by generating a location of the mobile tracking device; determining context information related to the location; and analyzing the location and context information to determine an appropriate speed of the mobile tracking device in view of the context information.

13 Claims, 5 Drawing Sheets

CONTEXT SENSITIVE SPEED TRACKING

CROSS-REFERENCE TO RELATED APPLICATIONS

This Application claims benefit of U.S. Provisional Patent Application Ser. No. 61/001,820, filed Nov. 5, 2007, which is herein incorporated by reference.

BACKGROUND OF THE INVENTION

1. Field of the Invention

Embodiments of the present invention generally relate to a method and apparatus for performing context sensitive speed tracking.

2. Description of the Related Art

Speeding of a driver may significantly impact road safety and may increase employer/guardian liability. Thus, in some cases a driver's speed is monitored and reported to an employer or a guardian. For example, the driving speed of commercial drivers may be monitored by the driver's boss or hiring personnel, a teen-ager's driving speed may be monitored by a guardian, and the like.

Monitoring the speed of a driver may be challenging. Complying with a road's speed limit may not be a true indication of the driver's quality of driving. The driving speed limit may be an unsafe driving speed when a road is congested or when the weather impairs a driver's road visibility. In other situations, exceeding the posted speed limit to conform to traffic flow may be the safest manner of driving.

Therefore, there is a need for a method and apparatus of tracking the speed of a driver, wherein the tracked speed is context sensitive.

SUMMARY

Embodiments of the present invention relate to a method and apparatus for performing a context sensitive speed tracking by generating a location of the mobile tracking device; determining context information related to the location; and analyzing the location and context information to determine an appropriate speed of the mobile tracking device in view of the context information.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
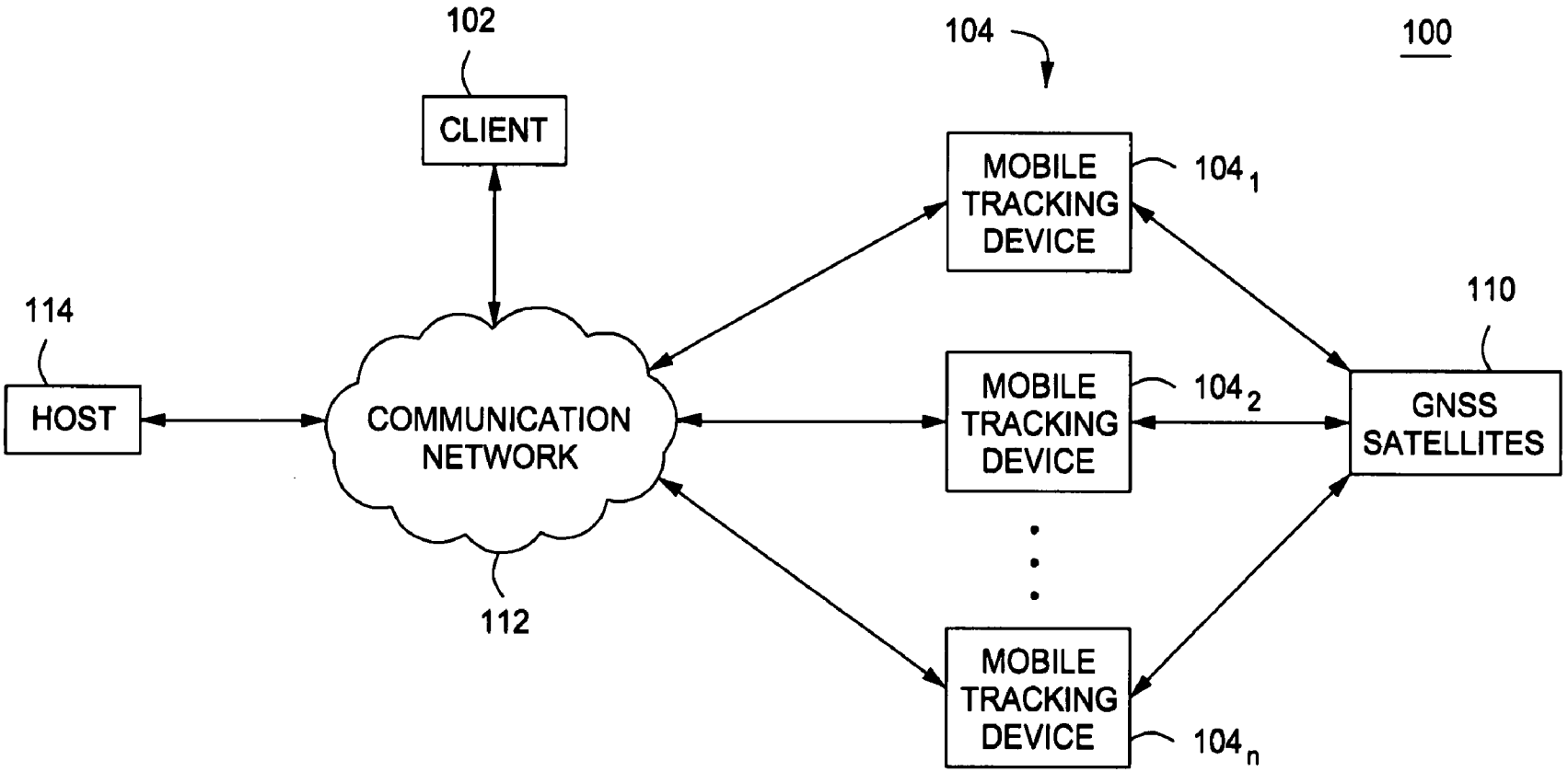
FIG. 1 depicts an exemplary high level overview of a tracking system for context sensitive speed tracking.

FIG. 1 depicts an exemplary high level overview of a tracking system 100 for performing context sensitive speed tracking. The tracking system 100 includes a client 102, mobile tracking devices $\mathbf{104}_1$, $\mathbf{104}_2$ . . . $\mathbf{104}_n$ (collectively referred to as mobile tracking devices 104), a network of Global Navigation Satellite System (GNSS) satellites 110 (e.g. Global Positioning System (GPS), Galileo, GLONASS, and the like), a communication network 112, and a host 114. The client 102 is able to track a position of the mobile tracking devices 104. In one embodiment, the mobile tracking devices 104 are individualized to each driver and/or vehicle. The client 102 may be an employer, a government agency, a parent or the like. The client 102 communicates with the host 114 via the communication network 112. The communication network 112 may be a public and/or a private network, such as, the Internet, a local area network, and the like. The communication network 112 may facilitate communications between the mobile tracking devices 104, the client 102, and/or the host 114.

Tracking information, such as, time, location, and speed information, for the mobile tracking devices 104, is computed by each mobile tracking device 104 using signals received from the GNSS satellites 110. The tracking information, relating to mobile tracking devices 104, may be sent to host 114 and/or client 102 via the communication network 110. In one embodiment, the host 114 (e.g., a co-location facility) may host the tracking system 100. It should be noted that while the present invention is described as working with the communication network 112, alternative communication methods may be utilized. Typically, the mobile tracking devices 104 communicate by wireless signals with the communication network 112. In one embodiment, the mobile tracking devices 104 are cellular telephones comprising GNSS receivers. In another embodiment, the mobile tracking devices 104 are purpose built tracking devices.

The host 114 and/or the client 102 may archive the tracking information. In addition, the host 114 and/or client 102 may calculate and archive the speed of the mobile tracking devices 104 of each vehicle and/or driver.

In one embodiment, the system 100 utilizes at least two (2) locations at two (2) different times to calculate the speed of the mobile tracking devices 104 by dividing the difference in distance between the two (2) locations by the difference of the two (2) times, wherein each time value relates to the time of the specific location retrieved. The location may be in longitude/latitude, miles, meters, and the like. The host and/or client may utilize the longitude/latitude to calculate the actual distance between the two (2) locations. The locations information utilized for calculating the speed may be consecutive locations of the mobile tracking device. In other embodiments, the mobile tracking devices 104 compute the device's speed from the GNSS signals and transmits the speed information to the host 114 and/or client 102.

In one embodiment, the tracking system 100 compares actual vehicle travel speeds with the legal and basic speed limits for contextual safety analysis. For example, the host 114 compares the calculated speed with the legal speed limit posted in the location of the mobile tracking devices 104. The host 114 matches the calculated speed against the legal speed limit of the route of the vehicle. The legal speed limit may be retrieved from a third party via the communication network 112 or may be archived in a database on the host 114. In another embodiment, the tracking system 100 compares the calculated speed against prevailing expected environmental conditions, such as location of the street traveled, weather conditions, zoning limitations, and other contextual information. As such, the driver's speed can be analyzed in view of the context in which the route is. Thus, the system 100 analyzes a context sensitive speed of the mobile tracking devices 104.

Information relevant to the mobile tracking devices 104, such as, calculated speed, location, legal speed limit, and/or traffic report, may be electronically delivered to the client 102 via web, email, or the like. In another embodiment, the client 102 may retrieve such information by accessing the host 114 via the network 112. The vehicle related information may include historical information, analysis report, or the like.

The tracking system 100 may be utilized for proactively identify high-risk drivers, increasing fuel efficiency, decreasing fuel costs, gaining context for infractions versus simple violation, improving fleet longevity, decreasing vehicle wear, growing profitability, decreasing insurance premiums, gaining broad use with easy user-interface, rewarding responsible driving, monitoring irresponsible driving, model best behavior benchmarks, and the like.

Figure 2:
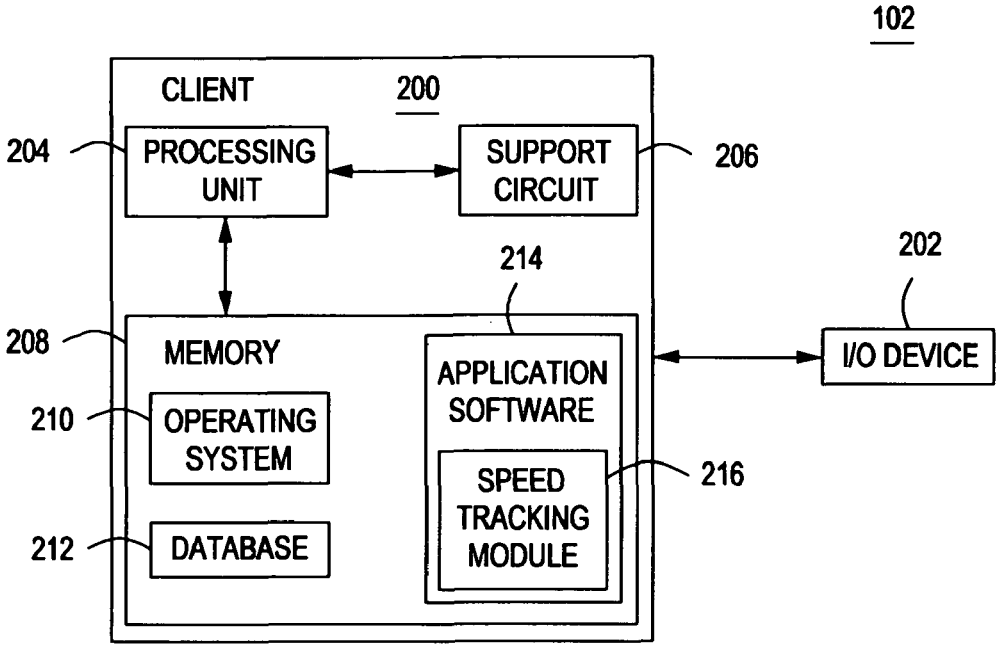
FIG. 2 depicts a block diagram of an exemplary overview of a client of a tracking system for context sensitive speed tracking.

FIG. 2 depicts a block diagram of an exemplary overview of a client 102 of FIG. 1. The client 102 comprises a client system 200 and input/output (I/O) devices 202. The client system 200 may communicate with the I/O devices 202, such as, a monitor, printer, communication device, and the like. The client system 200 comprises at least one processing unit 204, support circuits 206, and a memory 208. The processing unit 204 may comprise one or more conventionally available microprocessors. The support circuits 206 are well known circuits used to promote functionality of the processing unit 204. Such circuits include, but are not limited to, a cache, power supplies, clock circuits, I/O circuits and the like.

The memory 208 of the client system 200 may comprise random access memory, read only memory, removable disk memory, flash memory, and various combinations of these types of memory. The memory 208 is sometimes referred to as main memory and may, in part, be used as cache memory or buffer memory. The memory 208 generally stores the operating system 210 of the client system 200. The operating system 210 may be one of a number of commercially available operating systems such as, but not limited to, SOLARIS from SUN Microsystems, Inc., AIX from IBM Inc., HP-UX from Hewlett Packard Corporation, LINUX from Red Hat Software, Windows 2000 from Microsoft Corporation, and the like.

In addition, the memory 208 may store database 212, various forms of application software 214, such as, speed tracking module 216. The database 212 may comprise a relational database, for example, SQL from Oracle Corporation. The data in the database 212 may be accessible by the host 114. The data in the database 212 may be any data used by the operating system 210 or the application software 214. The speed tracking module 214 may utilize the tracking information from the mobile tracking devices 104 via the communication network 112 for determining the speed of the vehicle or driver of a specific speed tracking devices 104. The speed tracking module 216 may archive the tracking information and/or speed in the database 212.

To support the operation and functionality of the present invention, the memory 208 may be partially used as cache memory to temporarily store cached information. The speed tracking module 216 may utilize the memory 208 for system functions, such as, storing, viewing, editing, and the like.

Figure 3:
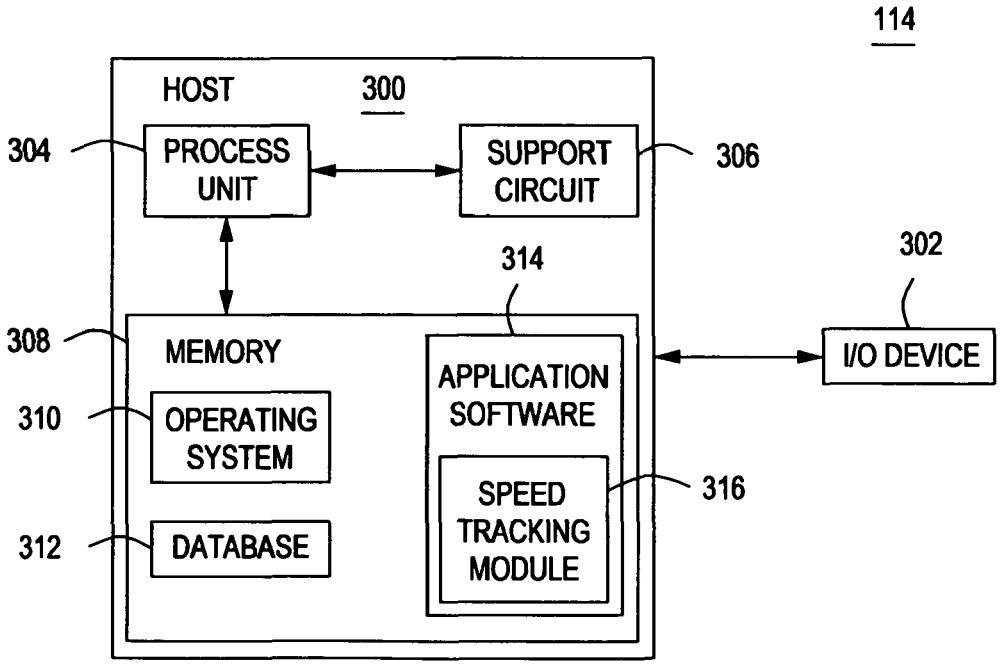
FIG. 3 depicts a block diagram of an exemplary overview of a host of a tracking system for context sensitive speed tracking.

FIG. 3 depicts a block diagram of an exemplary overview of a host 114 of FIG. 1. The host 114 comprises a client system 300 and input/output (I/O) device 302. The host system 300 may communicate with the I/O device 302, such as, a monitor, printer, communication device, and the like. The host system 300 comprises at least one processing unit 304, support circuits 306, and a memory 308. The processing unit 304 may comprise one or more conventionally available microprocessors. The support circuits 306 are well known circuits used to promote functionality of the processing unit 304. Such circuits include, but are not limited to, a cache, power supplies, clock circuits, input/output (I/O) circuits and the like.

The memory 308 of the client system 300 may comprise random access memory, read only memory, removable disk memory, flash memory, and various combinations of these types of memory. The memory 308 is sometimes referred to main memory and may, in part, be used as cache memory or buffer memory. The memory 308 generally stores the operating system 310 of the client system 300. The operating system 310 may be one of a number of commercially available operating systems such as, but not limited to, SOLARIS from SUN Microsystems, Inc., AIX from IBM Inc., HP-UX from Hewlett Packard Corporation, LINUX from Red Hat Software, Windows 2000 from Microsoft Corporation, and the like.

In addition, the memory 308 may store database 312, various forms of application software 314, such as, speed tracking module 316. The database 312 may comprise a relational database, for example, SQL from Oracle Corporation. The data of the database 312 may be any data used by the operating system 310 or the application software 314. The speed tracking module 316 may utilize the tracking information from the mobile tracking devices 104 via the communication network 112 for determining the speed of the vehicle or driver of a specific speed tracking devices 104. The speed tracking module 316 may archive the tracking information and/or speed in the database 312. The data in the database 312 may be accessible by the client 102. The database 312 includes data utilized for calculating and/or analyzing the context sensitive speed, such as, context information (i.e., weather, school zones, time of day, traffic information, construction information, etc.), maps, routes, driver's driving records and the like.

To support the operation and functionality of the present invention, the memory 308 may be partially used as cache memory to temporarily store cached information. The speed tracking module 316 may utilize the memory 308 for system functions, such as, storing, viewing, editing, and the like.

Figure 4:
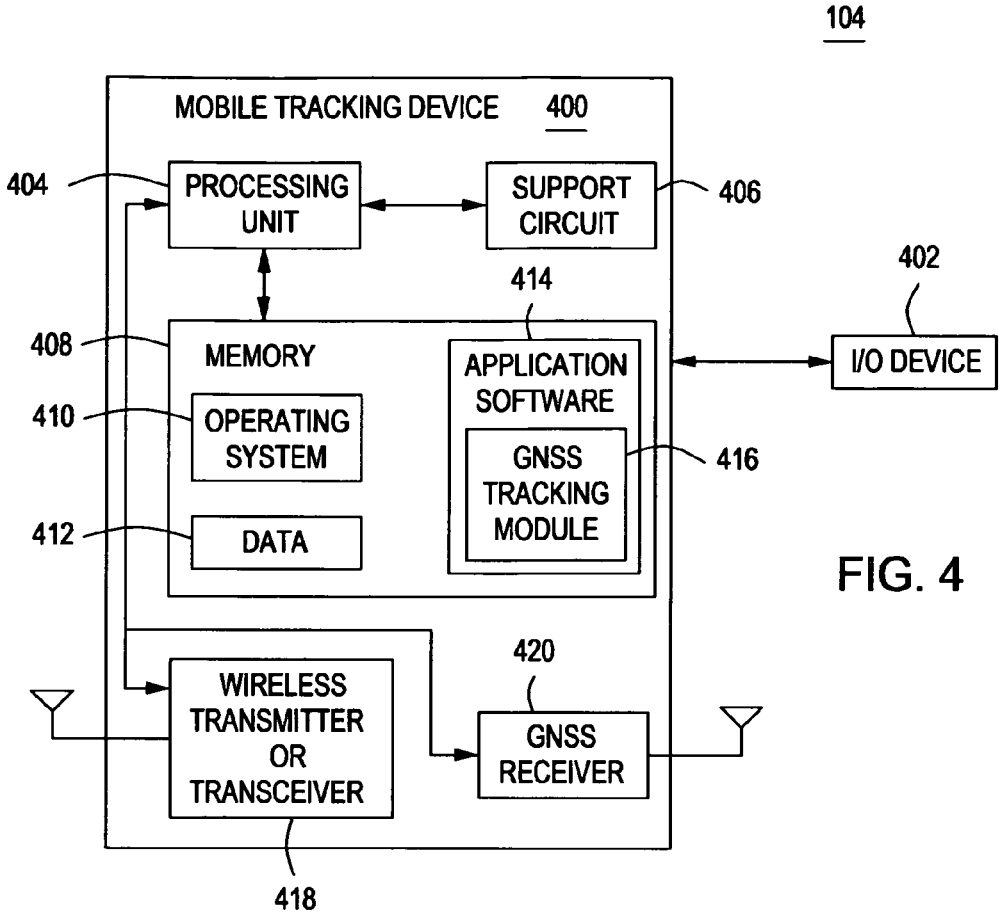
FIG. 4 depicts a block diagram of an exemplary overview of a mobile tracking device of a tracking system for context sensitive speed tracking.

FIG. 4 depicts a block diagram of an exemplary overview of the mobile tracking devices 104 of FIG. 1. The mobile tracking device 104 may communicate with an I/O device 402, such as, a monitor, printer, communication device, and the like. The mobile tracking device 104 comprises at least one central processing unit 404, support circuits 406, a memory 408, a wireless transmitter or transceiver 418, and a GNSS receiver 420. The processing unit 404 may comprise one or more conventionally available microprocessors. The support circuits 406 are well known circuits used to promote functionality of the processing unit 404. Such circuits include, but are not limited to, a cache, power supplies, clock circuits, input/output (I/O) circuits and the like.

The memory 408 of the client device 400 may comprise random access memory, read only memory, removable disk memory, flash memory, and various combinations of these types of memory. The memory 408 is sometimes referred to main memory and may, in part, be used as cache memory or buffer memory. The memory 408 generally stores the operating system 410 of the client device 400. The operating system 410 may be one of a number of commercially available operating systems such as, but not limited to, SOLARIS from SUN Microsystems, Inc., AIX from IBM Inc., HP-UX from Hewlett Packard Corporation, LINUX from Red Hat Software, Windows 2000 from Microsoft Corporation, and the like. The mobile tracking device may be a hand held device such as a cell phone or personal digital assistant (PDA), where the operating system will be a type that is used with such a mobile device.

In addition, the memory 408 may also store data 412, various forms of application software 414, such as, GNSS software module 416. The GNSS software module 416 operates in conjunction with the GNSS receiver 420 to compute location information and/or speed in a conventional manner. The location information is sent to the host 114 (shown in FIG. 1) and/or client 102 (shown in FIG. 1) via the wireless transmitter or transceiver 418. Such information may include the time/date the mobile tracking device 104 received the data via the GNSS receiver 420 and/or the time/date the mobile tracking device 104 transmitted the data via the wireless transmitted or transceiver 418. As such, the time/data information may be used by the host 114 to analyze the context information at the time and in the location relevant to the mobile tracking device 104.

To support the operation and functionality of the present invention, the memory 408 may be partially used as cache memory to temporarily store cached information. The speed tracking module 416 may utilize the memory 408 for system functions, such as, storing, viewing, editing, and the like.

Figure 5:
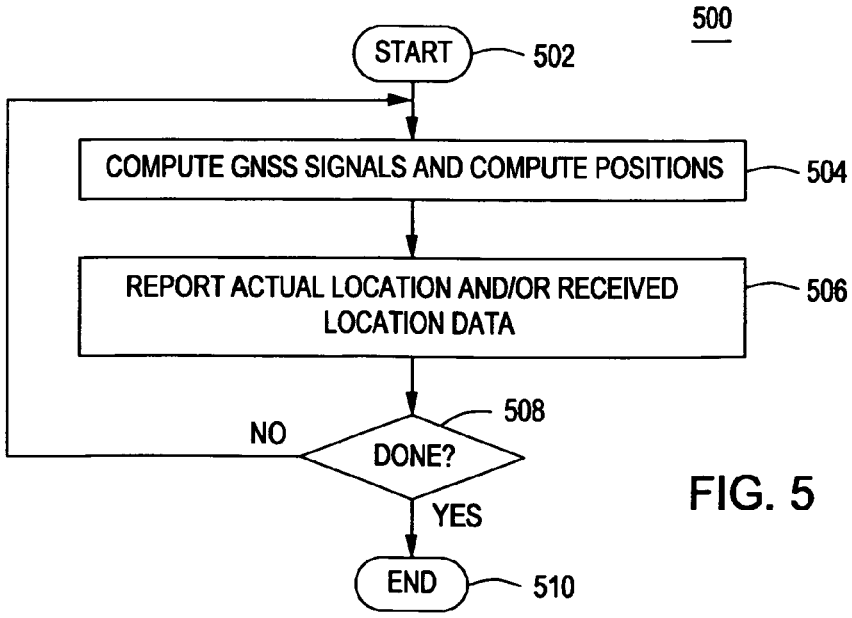
FIG. 5 depicts an exemplary overview of a method for a mobile tracking device used for context sensitive speed tracking.

FIG. 5 depicts an exemplary overview of a method 500 for a mobile tracking device used for context sensitive speed tracking. The method 500 starts at step 502 and proceeds to step 504. At step 504, the mobile tracking device receives GNSS satellite signals and computes position. At step 506, the mobile tracking device reports the computed location, speed, or both to the host. At step 508, the method 500 queries whether the process is completed. If the process is not completed, the method 500 proceeds from step 508 to step 504. If the process is completed, the method 500 proceeds from step 508 to step 510. At step 510, the method 500 ends.

Figure 6:
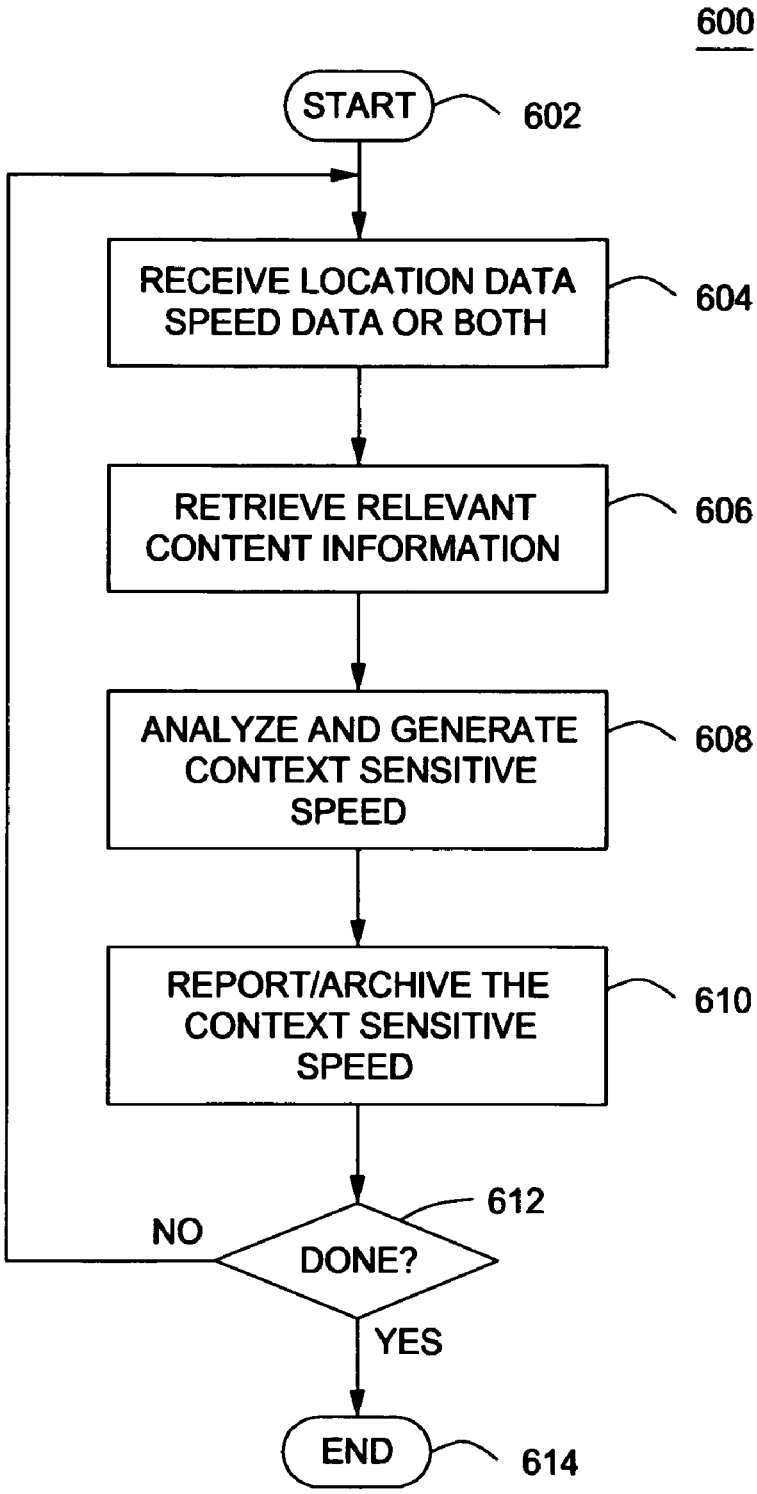
FIG. 6 depicts an exemplary overview of a method for a host used for context sensitive speed tracking.

FIG. 6 depicts an exemplary overview of a method 600 for a host used for context sensitive speed tracking. The method 600 starts at step 602 and proceeds to step 604. At step 604, the host receives the computed location and/or speed from the mobile tracking device. If the host only received the location information, the host computes the speed of the mobile tracking device utilizing the location information received. Thus, the speed of the mobile tracking device may be calculated by the mobile tracking device or the host. At step 606, the host retrieves the relevant context information that corresponds to the location of the device. At step 608, the host analyzes the speed in view of the context information and generates a context sensitive speed. The context sensitive speed is the speed of the mobile tracking device in relation to the factors surrounding the mobile tracking device. For example, the context sensitive speed accounts for school zones, weather factors, construction, speed, and the like. In one embodiment, the host may compare the speed of the mobile tracking device with the retrieved context information and reports suitability of the computed speed. In another embodiment, the host may compute a safe-speed threshold and may report both the computed speed and the safe-speed threshold to determine the suitability of the speed of the mobile tracking device. At step 610, the host reports and/or archives the context sensitive speed. At step 612, the method 600 queries whether the process is completed. If the process is not completed, the method 600 proceeds from step 612 to step 604. If the process is completed, the method 600 proceeds from step 612 to step 614. At step 614, the method 600 ends.

Figure 7:
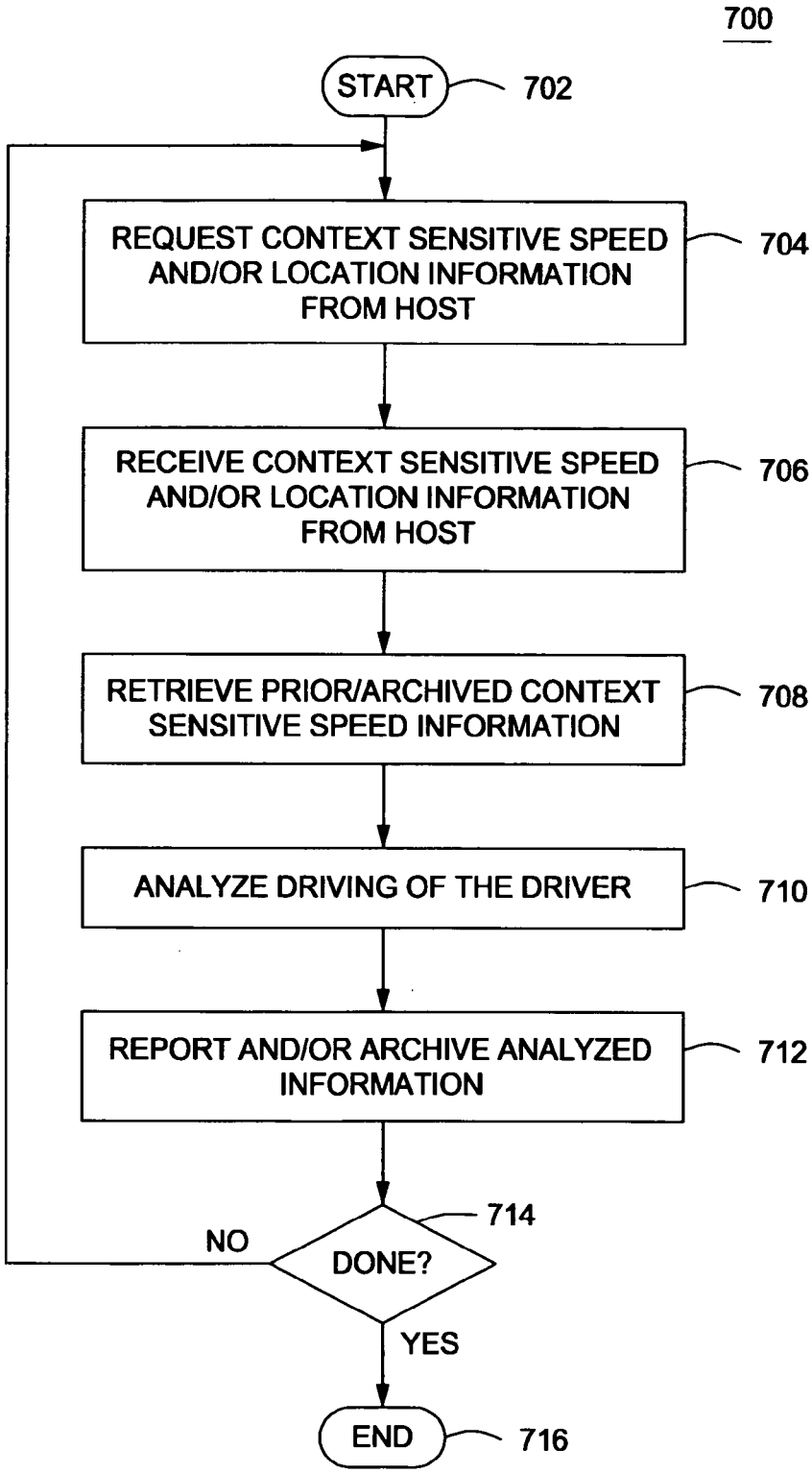
FIG. 7 depicts an exemplary overview of a method for a client used for context sensitive speed tracking.

FIG. 7 depicts an exemplary overview of a method 700 for a client operation used for context sensitive speed tracking. The method 700 starts at step 702 and proceeds to step 704. At step 704, the client requests context sensitive speed information and/or location information from the host. At step 706, the client receives context sensitive speed information and/or location information. At step 708, the client retrieves prior/archived context sensitive speed information. At step 710, the client analyzes the driving speed of the driver of the relevant mobile tracking device. At step 712, the client reports and/or archives analyzed information. At step 714, the method 700 queries whether the process is completed. If the process is not completed, the method 700 proceeds from step 714 to step 704. If the process is completed, the method 700 proceeds from step 714 to step 716. At step 716, the method 700 ends.

While the foregoing is directed to embodiments of the present invention, other and further embodiments of the invention may be devised without departing from the basic scope thereof.

What is claimed is:

1. Apparatus for providing context sensitive speed tracking comprising:

a mobile tracking device for generating a location of the mobile tracking device; and a host, coupled to the at least one mobile tracking device, for receiving the location, determining context information related to the location, and analyzing the location and context information to determine an appropriate speed of the mobile tracking device in view of the context information, wherein the host analyzes a speed of the mobile tracking device related to the context information and the host generates context sensitive speed information, and wherein the host logs the context sensitive speed information within a database and communicates information related to the context sensitive speed information to a client.

2. The apparatus of claim 1 wherein at least one of the mobile tracking device or the host computes a present speed of the mobile tracking device.

3. The apparatus of claim 2 further comprising a client, coupled to the host, for utilizing information related to the present speed in view of the appropriate speed.

4. The apparatus of claim 1 wherein the host analyzes the context information at the time and location relevant to the mobile tracking device.

5. The apparatus of claim 1 wherein the host computes the speed of the at least one mobile tracking device.

6. The apparatus of claim 1 wherein the context information comprises environmental conditions proximate the location of the mobile tracking device.

7. The apparatus of claim 6 wherein the environment conditions comprise at least one of location of a street traveled, speed limits, weather conditions, zoning limitations, current traffic congestion, or current traffic speed.

8. A method of providing context sensitive speed tracking comprising:

generating a location of the mobile tracking device;

determining context information related to the location;

analyzing the location and context information to determine an appropriate speed of the mobile tracking device in view of the context information and generating context sensitive speed information by analyzing the current speed of the mobile tracking device in view of the appropriate speed and the context information;

storing the context sensitive speed information within a database to maintain a record of context sensitive speed information; and communicating information related to the context sensitive speed information to a client.

9. The method of claim 8 wherein a present speed of the mobile tracking device is computed or reported by the mobile tracking device.

10. The method of claim 9 further comprising comparing the present speed to the appropriate speed.

11. The method of claim 8 wherein the analyzing step utilizes context information at a time and location relevant to the mobile tracking device.

12. The method of claim 8 wherein the context information comprises environmental conditions proximate the location of the mobile tracking device.

13. The method of claim 12 wherein the environment conditions comprise at least one of location of a street traveled, speed limits, weather conditions, zoning limitations, current traffic congestion, or current traffic speed.

* * * * *